United States Patent [19]

Wieder et al.

[11] 4,059,265

[45] Nov. 22, 1977

[54] ELASTIC PULL-TYPE EXERCISER

[76] Inventors: Horst K. Wieder, 1207 Riverview Lane, Watertown, Wis. 53094; Klaus A. Wieder, Rte. No. 1, Helenville, Wis. 53137

[21] Appl. No.: 651,271

[22] Filed: Jan. 22, 1976

[51] Int. Cl.[2] ..... A63B 21/04

[52] U.S. Cl. ..... 272/137; 272/143; 272/136; 272/142; 272/900

[58] Field of Search ..... 272/75, 74, 116, 137, 272/138, 143; 273/73 J; 132/84; 81/177 R, 177 A, 177 B, 177 C; 16/116 R

[56] References Cited

U.S. PATENT DOCUMENTS

| | | | |
|---|---|---|---|
| 1,750,644 | 3/1930 | Norton | 273/73 J |
| 2,104,129 | 1/1938 | Kress | 145/61 C |
| 3,256,015 | 6/1966 | Perrin | 272/137 X |
| 3,302,322 | 2/1967 | Rubio | 46/62 |
| 3,730,523 | 5/1973 | McRae | 272/68 |

*Primary Examiner*—Richard C. Pinkham
*Assistant Examiner*—William R. Browne
*Attorney, Agent, or Firm*—John M. Diehl

[57] ABSTRACT

Grip member for elastic cord used for exercising contains two parallel cylindrical bores with slightly greater diameter than the cable, to slidingly receive the cable and prevent sliding of the cable through the grip member and permit adjusting of the active length of the cable used in any specific exercise. A tubular member receives one of the hand grip members in each end and may serve to simulate a bar used to lift weights, a golf club handle, a tennis racket handle, a baseball bat, a canoe paddle, a hockey stick, or the like. A device is provided to attach the cable at the juncture of a door and door frame.

4 Claims, 13 Drawing Figures

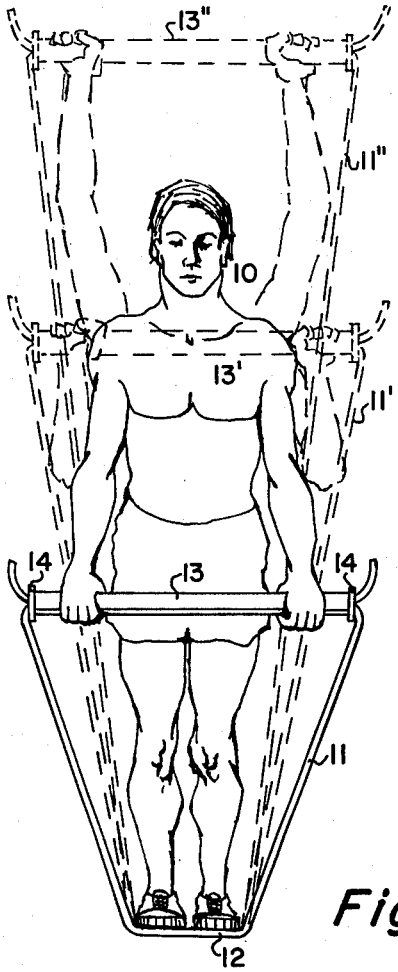
Fig. 1.
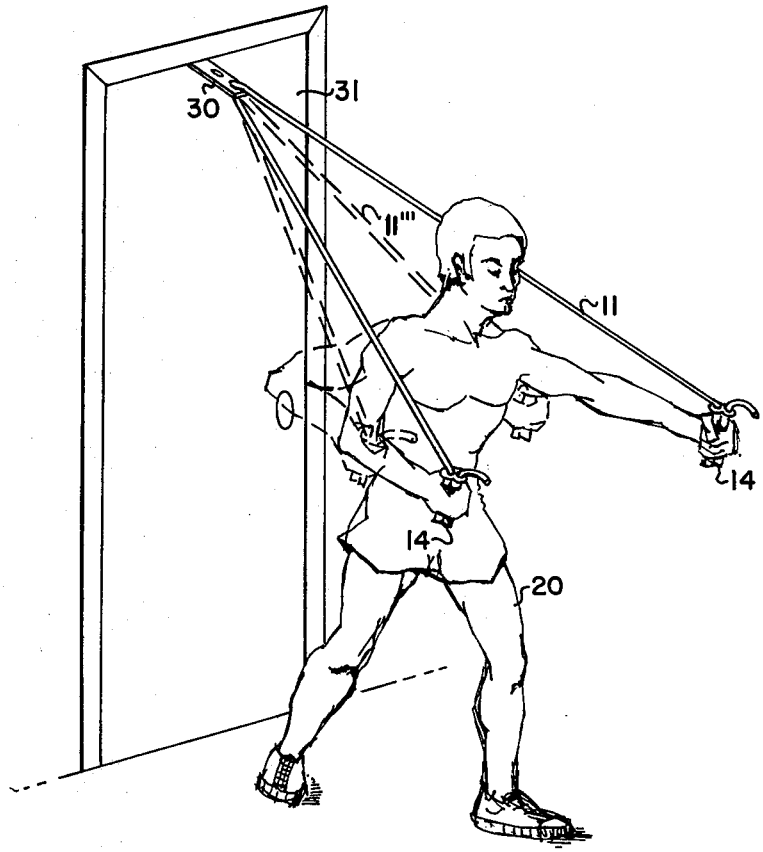
Fig. 2.
Fig. 3.
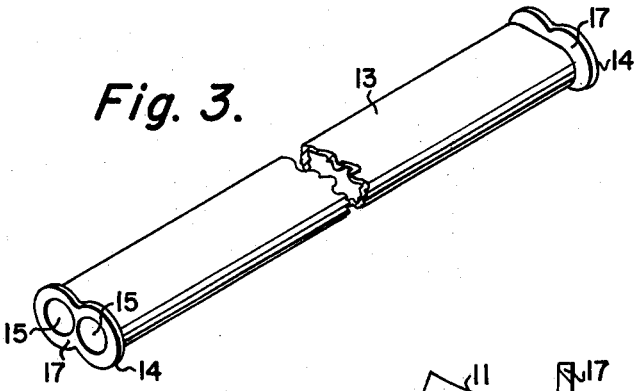
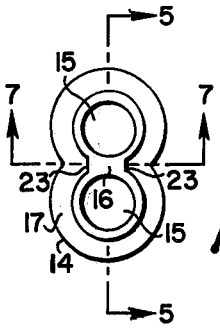
Fig. 4.
Fig. 5.
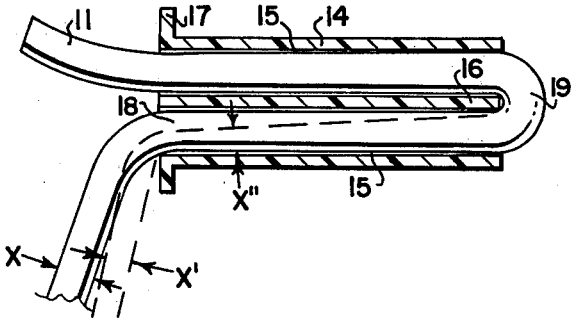

ELASTIC PULL-TYPE EXERCISER

FIELD

This invention relates to an exercising device and more particularly to an exercising device in which an elastic cord or more particularly an elastomeric cable or cord is utilized.

PRIOR ART

An elastic or elastomeric member was described as early as 1867 in U.S. Pat. No. 61,702.

The use of a bar with an elastic cord in a manner simulating weight lifting was described in 1912 in U.S. Pat. No. 1,019,861. A golf swing conditioner utilizing an elongated elastic member is described in U.S. Pat. No. 2,848,234 and a pull-type exerciser in which an elastic tubing is utilized has been described as recently as 1972 in U.S. Pat. No. 3,677,543.

The present invention describes improved means for grasping an elastic cord used in exercising and for utilizing such a cord in many different ways and for adjusting the length of the cord in order to adjust the tension imposed on the muscles of the user.

SUMMARY

A hand grip member is provided which contains two parallel cylindrical passages having a diameter just slightly greater than that of the diameter of the elastic cable. The cable may be passed first through one passage and then through the other and pulled tight whereupon the hand grip member will not slip along the cable even though the user exerts the maximum force of which he is capable to stretch the cable, using the hand grip.

A tubular bar member is provided to slidingly receive one of said hand grips at each of its ends in order to provide a bar which may simulate a bar used in lifting weights. Only one of the hand grips may be inserted at one end of the bar whereupon the bar may be utilized to simulate a golf club handle, canoe paddle, hockey stick, tennis racket, or the like. A device is provided for attaching the cable to the juncture of a door and door frame with superior effectiveness.

OBJECTS

It is therefore an object of the invention to provide an improved exercising device.

Another object of the invention is to provide improved means to grip an elastomeric cable utilized in exercising.

Other objects will become apparent from the drawings and from the following detailed description in which it is intended to illustrate the applicability of the invention without thereby limiting its scope to less than that of all equivalents which will be apparent to one skilled in the art.

DRAWINGS

In the drawings like reference numerals refer to like parts and:

FIG. 1 is an elevation showing hand grips and the bar member of the invention in use;

FIG. 2 is a perspective view showing hand grips and door attachment member in use;

FIG. 3 is a perspective view of the bar member of the invention having hand grip members of the invention received therein;

FIG. 4 is an end elevation of the hand grip member of the invention;

FIG. 5 is a cross-sectional view taken on lines 5—5 in FIG. 4;

DESCRIPTION

Figure 6:
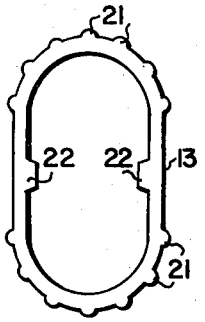
FIG. 6 is an end elevation of the bar member of the invention.
Figure 7:
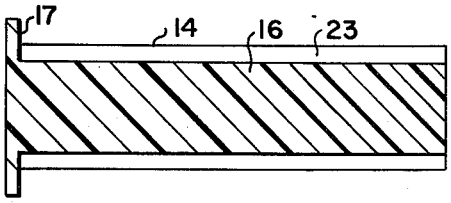
FIG. 7 is a cross-sectional view taken on lines 7—7 in FIG. 4.

Referring now to FIG. 1, a person 10 may utilize an elastic cord or cable 11 for training or exercising in the manner of weight lifting by standing on the cord with his feet, as indicated at 12, and firmly grasping tubular bar member 13 having hand grip or cable grip members 14 received in its ends as shown also in FIG. 3. By raising his arms in progressive stages he may stretch member 11 and lift bar or tubular member 13 to the positions shown respectively at 11′ and 13′ and 11′ and 13′.

The elastic cord or cable may be of rubber or other elastomeric polymeric resinous material.

Each of members 14 is provided with a pair of cylindrical passage or apertures 15 which have a thin web between them as indicated at 16 and which are parallel (their axes are parallel) and substantially identical in diameter and are coterminous, that is, each has the same length and they lie alongside each other (FIGS. 3, 4, 5 and 7). The diameter of each cylindrical bore 15 is only slightly greater than the diameter of the cable 11 so that cable 11 may be slidingly received in each passage 15. Each of members 14 may if desired be provided with a flange 17 at one end.

Referring to FIG. 2 a person 20 may utilize the hand grips 14 of the invention together with an elastic cord 11 together with member 30 of the invention to attach cord 11 to door 31 and exercise the muscles of his arms by repeatedly moving hand grips 14 with his arms to stretch cable 11 from the positions shown at 11‴ in dashed lines to the position shown in full lines. As member 11 is stretched to the position shown at 11′ or the position shown at 11‴in FIG. 1 or from the position shown at 11‴ in FIG. 2 to the position shown in full lines in FIG. 2 it is both stretched or elongated on the one hand and its thickness is attenuated or in other words it becomes thinner as indicated at X and X′, its thickness being reduced from its unstretched thickness of X to a much reduced dimension indicated at X′ in FIG. 5. Correspondingly its thickness is reduced within one of bores 15 as indicated at X'' leaving a space in said bore as indicated at 18. However, as indicated in FIG. 5 and in FIGS. 1 and 2 the hereinbefore described structure of hand grip member 14 prevents cable 11 from sliding therethrough and effectively serves as a grip to effectively and firmly grasp cable 11. However, the effective or active length of cable 11 from the point of view of person 10 or 20 may be easily changed by sliding the bight of one end of cable 11 through one of passages 15 to make a loop instead of a mere bend at 19 and then drawing the other end of cable 11 through the other bore 15 to in effect lengthen the cable. Shortening of the effective length of the cable may be effectuated in a reverse manner.

Figure 13:
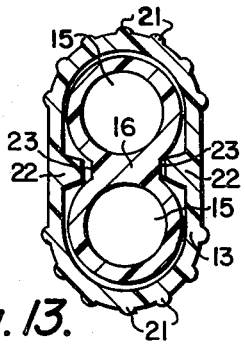
FIG. 13 is a cross-sectional view corresponding to that of FIG. 6 of a hand grip member of FIGS. 4 and 5 received in the tubular bar member of FIG. 6.

Referring now to FIG. 6 tube 13 may be provided with external ribs 21 to facilitate gripping it with the hands and with internal strengthening ribs 22 which may be received in grooves 23 provided in the body portion of member 14 adjacent web 16, when one of members 14 is received in tube 13 as shown in FIG. 13, the appropriate portions of the outer surface of member 14 being configured to conform in shape to passages 15 and to be slidingly received in tube 13.

Figure 8:
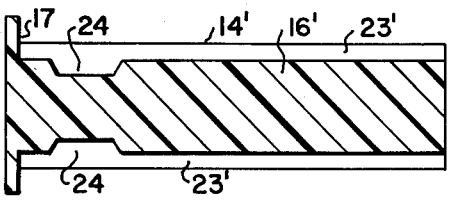
FIG. 8 is a cross-sectional view corresponding to the view of FIG. 7 of a modification of the embodiment of FIG. 7.
Figure 9:
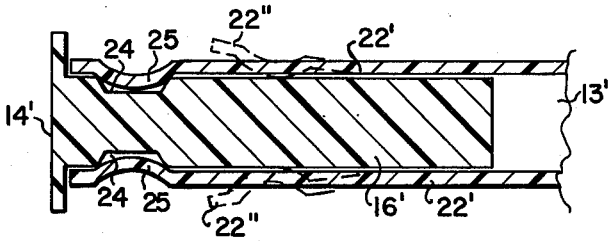
FIG. 9 is a cross-sectional view of the embodiment of FIG. 8 received in the end of a bar member according to the invention, said bar member being a modification of the bar members of FIGS. 3 and 6.

As shown in FIG. 8, member 14 may be modified as indicated by member 14' by providing a deeper portion 24 of groove 23' as an indentation and web 16' or a pair of same as shown, and tube 13 may be modified as shown for tube 13' by providing depressed portions 25 or ribs 22' which may be received in indentations 24 for the purpose of locking each of members 14 into an end of tube 13 (or 13') to accomplish either the insertion or removal of one of members 14' in an end of tube 13'. It may be either inserted or withdrawn with such force as to deform tube 13' and ribs 22' as indicated at 22'' in dashed lines to permit withdrawal or insertion of member 14', the material of which tube 13' is made being chosen to be of such a sufficiently resilient nature to permit such resilient deformation.

Figure 11:
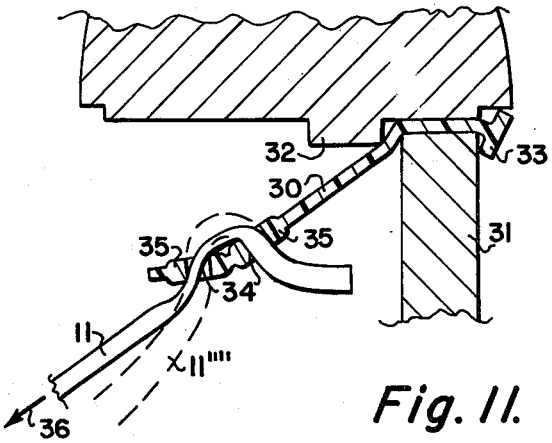
FIG. 11 is a cross-sectional view of the strap member of FIG. 10 received in a juncture of a door and door frame.
Figure 12:
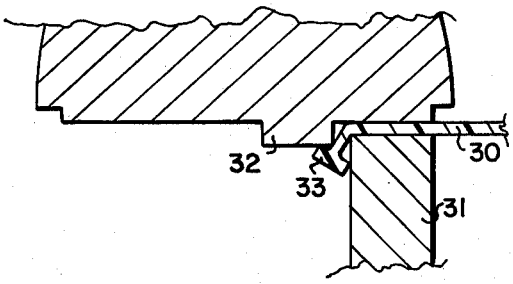
FIG. 12 is a cross-sectional view of the strap member of FIGS. 10 and 11 received in a juncture of a door and door frame in a different manner.

Referring now to FIG. 11, thin elongated strap member 30 consisting of a single molding of resiliently deformable polymeric resinous material may be attached at the juncture of a door 31 and casing or jamb 32 by insertion in the space therebetween as shown, the material of member 30 being sufficiently flexible and resilient enough to permit and facilitate such insertion and member 30 being provided at one end with an enlarged portion 33 which may engage with door 31 and jamb or casing 32 in such manner as to prevent its withdrawal. In FIG. 11 member 30 is shown as being inserted in such manner that tension applied to the end of member 30 which is opposite enlarged portion 33 tends to force door 31 closed but as shown in FIG. 12 it may be inserted in the other way equally effectively, the hinges and latch of the door (not shown for simplicity) being relied upon to prevent opening of the door in such circumstances. It has been found in fact that the device may be utilized quite effectively without damage to doors and without causing member 30 to pull loose either in the manner of insertion shown in FIG. 11 or in that of FIG. 12.

Member 30 is preferably provided with two circular holes or apertures 34 in which cable 11 may be slidingly received as shown in FIG. 11 which may if desired be provided with enlarged strengthening portions 35 at their peripheries. Apertures 34 have a diameter only slightly greater than that of cable 11 and are spaced apart a distance less than one of said diameters. Cables 11 may be inserted and when unstressed will occupy the position shown in dashed lines at 11'''' and when tension is exerted thereon as indicated by arrow 36 will occupy the position shown in full lines, being much attentuated and reduced in thickness adjacent holes 35, yet the holes as shown being close together and being less than one diameter apart are such as to prevent withdrawal of the cable from the holes and from attachment to device 30 at values of tension 36 below the ultimate tensile strength of cables 11 or member 30.

Figure 10:
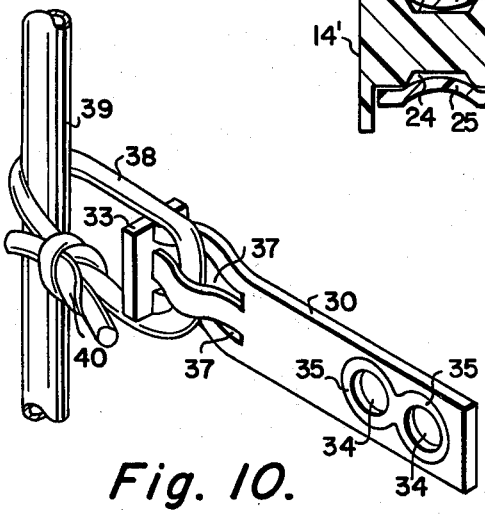
FIG. 10 is a perspective view of the attaching strap member of the invention attached to a vertical object such as a pipe.

Referring now to FIG. 10 member 30 may be provided with slots or slits 37 through which a rope 38 or other flexible member may be passed and then passed around a pipe, stanchion or other member 39 and tied at knot 40. In this manner member 30 may be secured to one of a large number of objects if a door is not available to provide attachment in the manners shown in either FIGS. 11 or 12.

It will be apparent to those skilled in the art that equivalents may be utilized.

Accordingly, the present invention may be embodied in other specific forms without departing from the spirit or essential attributes thereof, and accordingly, reference should be made to the appended claims rather than to the foregoing specification as indicating the scope of the invention.

It is claimed:

1. In an exercise device comprising an elongated elastomeric member or cable for exercising, the combination comprising:

a bar means for removably securing a grip member in each of its respective ends, an elongated elastic member or cable, a grip member adapted to be inserted in the ends of said bar means, said grip member being elongated to provide a first end and a second end, said grip member having two cylindrical passages each communicating from said first end to said second end and each having an axis, each of said passages having a diameter only slightly greater than the diameter of said cable to thereby slidingly receive said cable in said passage, said passages being contiguous and separated only by a web portion of said grip member, said axes of said passages being parallel, said grip member having an outer surface with portions of said outer surface conforming in shape to portions of said passages contained in said grip member, said grip member having an enlarged portion at one end for limiting the extent of travel of each grip member within the bar means.

2. The device of claim 1, further comprising:

a tubular passage in said bar means communicating from said first end to said second end, said tubular passage configured to slidingly receive one of said grip members at each of said first and second ends.

3. The device of claim 2 wherein said bar means is of substantially uniform cross-section.

4. The device of claim 2, further characterized by said grip member and said bar means being provided with interlocking portions to hold said grip member to said bar means, said interlocking portion on at least one of said members being resilient to facilitate engagement and disengagement of said interlocking portions by resilient deformation of said resilient portion.

* * * * *